US006682463B2

(12) United States Patent
Jackson

(10) Patent No.: US 6,682,463 B2
(45) Date of Patent: Jan. 27, 2004

(54) FLUID COLLECTION SYSTEM FOR RING EVENTS

(76) Inventor: Kenneth Michael Jackson, 17814 N. 13th Pl., Phoenix, AZ (US) 85022

( * ) Notice: Subject to any disclaimer, the term of this patent is extended or adjusted under 35 U.S.C. 154(b) by 30 days.

(21) Appl. No.: 10/039,963

(22) Filed: Jan. 2, 2002

(65) Prior Publication Data

US 2002/0091040 A1 Jul. 11, 2002

Related U.S. Application Data

(60) Provisional application No. 60/260,146, filed on Jan. 8, 2001.

(51) Int. Cl.[7] ..... A63B 69/34
(52) U.S. Cl. ..... 482/83
(58) Field of Search ..... 141/65, 59, 73; 15/300.1, 300.2; 134/21; 169/30, 34; 482/83–90

(56) References Cited

U.S. PATENT DOCUMENTS 1,898,887 A * 2/1933 Naul
2,681,466 A * 6/1954 Nelson
2,779,046 A * 1/1957 Queirolo
3,064,298 A * 11/1962 Jones
3,165,773 A * 1/1965 Palpacella
3,786,531 A * 1/1974 Borg ..... 15/310
5,305,494 A * 4/1994 Chandler ..... 15/304

* cited by examiner

*Primary Examiner*—Jerome W. Donnelly

(57) ABSTRACT

The fluid collection system for ring events comprises a mat, an extraction port and connector, a flexible hose and wet vacuum source. The mat has raised edges to support a sloped surface that gravity feeds the extraction port and raised gasket depressions to support a ring stool. The extraction port has apertures for drainage and is connected to the flexible hose and wet vacuum source by the extraction port connector. This connector fits into at the rear of the extraction port at the 90° angle of the mat. The mat is hinged to allow it to fold in either direction for rapid deployment and removal. When the mat is deployed, all fluids distributed in the competitors corners will be removed by aide of gravity and the wet vacuum source, leaving the surfaces clean and dry. The fluid collection system promotes safety, hygienic, fair ring event conditions.

3 Claims, 3 Drawing Sheets

FLUID COLLECTION SYSTEM FOR RING EVENTS

CROSS REFERENCE TO RELATED APPLICATIONS

This application claims the benefit of U.S. Provisional Application No. 60/260,146 filed on Jan. 8, 2001, which is incorporated by reference.

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND OF INVENTION

The present invention relates to the sports of boxing, kickboxing or ring events where the competitors retire to their respective corners for rest and fluid replenishment. Currently all ring event sports allow the use of water in the corners to both cool and replenish body fluids.

The standard material used to cover the ring surface is triple reinforced extra thick 18-oz. canvas. This canvas covers a full 1" thick, 2lbs. E.V.A. shock absorbing padding meeting the standards of all professional and amateur ring events commissions.

Ring canvas is not treated with water-resistant materials. Thus, if the first bout of a multi-bout event in a boxing, kickboxing or ring event uses a minimal amount of water, 8 to 32 ounces, the ring corners canvas and underpadding are permanently wet throughout the entire event.

Prior to the present invention the total amount of water used in the corner of a boxing, kickboxing or ring event spilled onto the standard canvas in each competitors comer.

This wetness creates a number of hazards for which the fluid collection system for ring events eliminates.

First, the surface of the ring is slippery and could and has caused injury to the competitors and their support personnel.

Second, the excretion of body fluids, blood, spit and perspiration, onto the standard canvas presents non-hygienic, biohazard conditions.

Finally, wet corner conditions do not allow the competitors to compete in fair, unimpaired ring conditions throughout a multi-bout event.

BRIEF SUMMARY OF THE INVENTION

It is the object of the present invention to collect and dispose of all fluids distributed in the competitors corners using both sloped surface gravity and wet vacuum source drainage during both the training and competition of boxing, kickboxing and ring events.

Accordingly, it is the object of the present invention to provide safe boxing, kickboxing and ring event conditions during both training and competitive events.

Yet another object of the present invention is to provide hygienic, biohazard compliant corner conditions during both training and competitive boxing, kickboxing and ring events.

Another object of the present invention is to provide fair competition throughout the boxing, kickboxing or ring event.

Another object of the present invention is to provide the additional use of fluids to cool and replenish the competitors during training and competition without causing hazardous ring corner conditions.

It is another object of the present invention to provide customization of color, design, logo, symbol, letter(s) or word(s) imprinted on or about the surface of the invention.

DETAILED DESCRIPTION OF THE INVENTION

Figure 2:
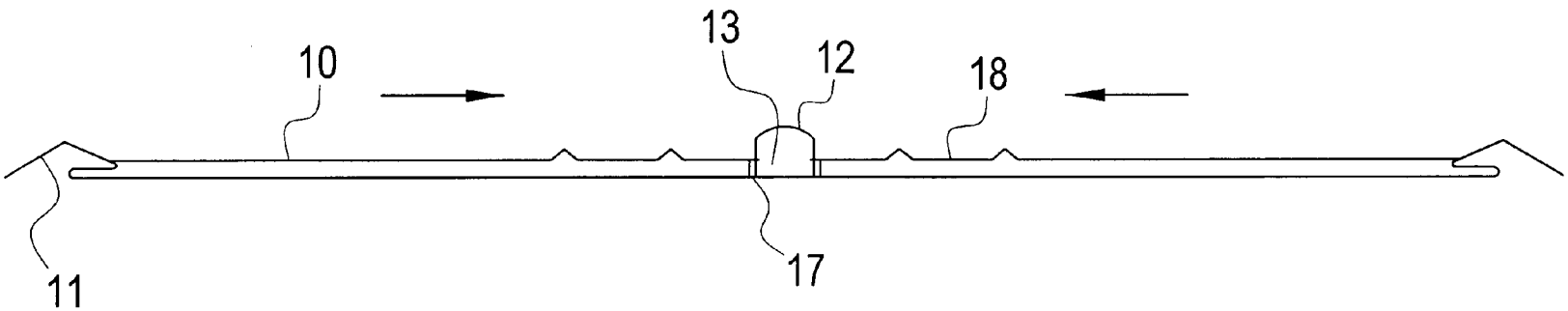
FIG. 2 is a schematic cross-section of the fluid collection mat taken along line 2—2 in FIG. 1.

1. With further reference to the drawings, the present invention is a mat 9 designed such that it represents 90° of a complete circle, manufactured from water-resistant polyplastic materials. As shown in FIG. 2, the mat 9 provides a sloped surface 10 from the outer elevated edges 11 to the gravity feed extraction port 12. The elevated edges 11 provide a non-slip, non-trip edge to the mat 9. The extraction port 12 bisects the length of the mat 9 with a sealed sloped front edge 14 and bilateral periodic aperture openings 13 for drainage. The extraction port 12 has connection means 15 at the rear of said port to support the extraction port connector 16. The mat 9 has hinges 17 that allow it to fold for ease of deployment and removal. The mat 9 contains raised gasket depressions 18 to support a standard ring event stool and the weight of any ring event competitor.

Figure 3:
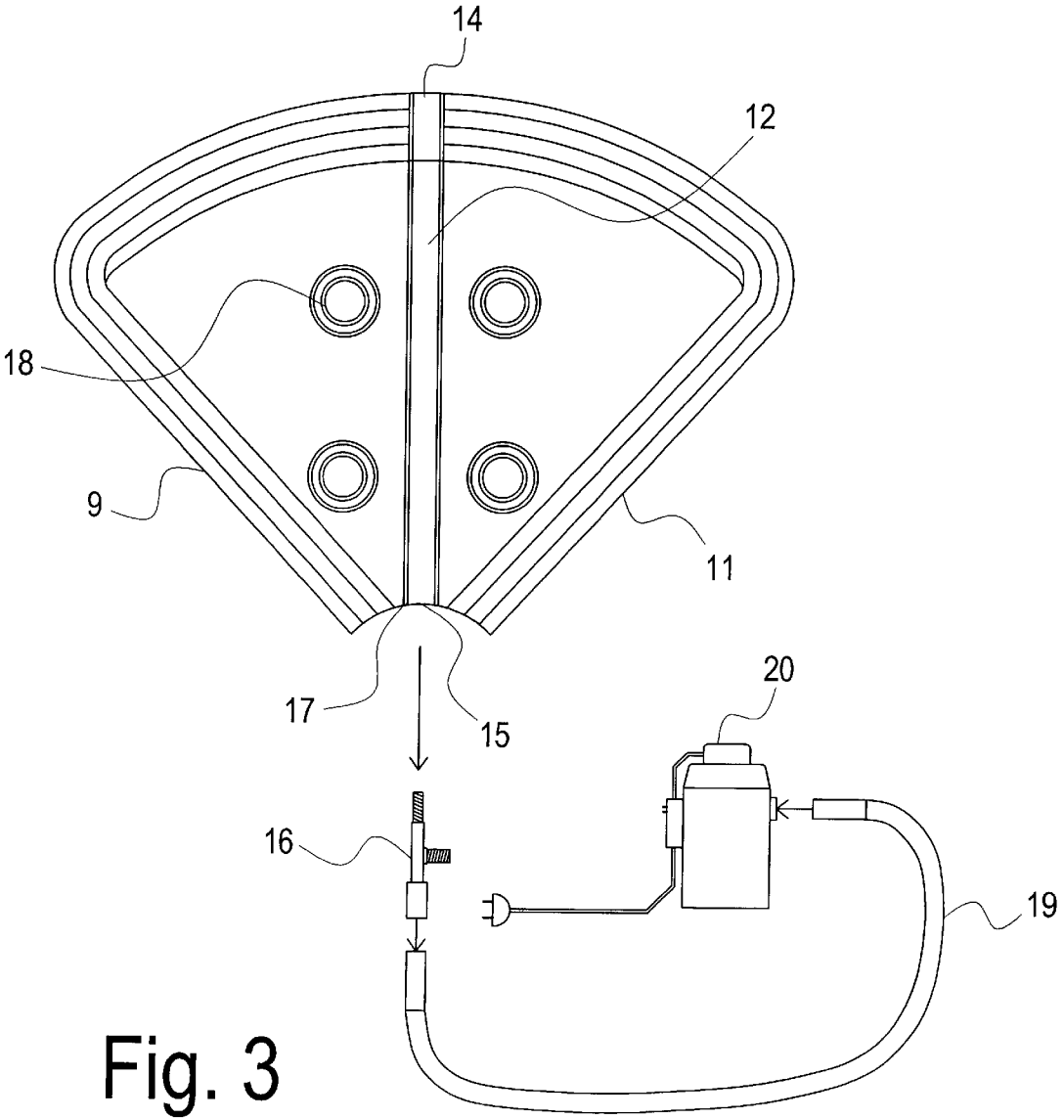
FIG. 3 is top view of the fluid collection system including; mat with extraction port, extraction port connector, flexible hose and side view of the wet vacuum source.

2. As shown in FIG. 3 the extraction port connector 16 constructed from commercially available plastic tubing, is connected at a first end to the 90° angle of the mat at the rear end of the extraction port 12. The extraction port connector 16 connects to the flexible hose 19 by a second connection means and the flexible hose connects to the wet vacuum source 20.

Figure 1:
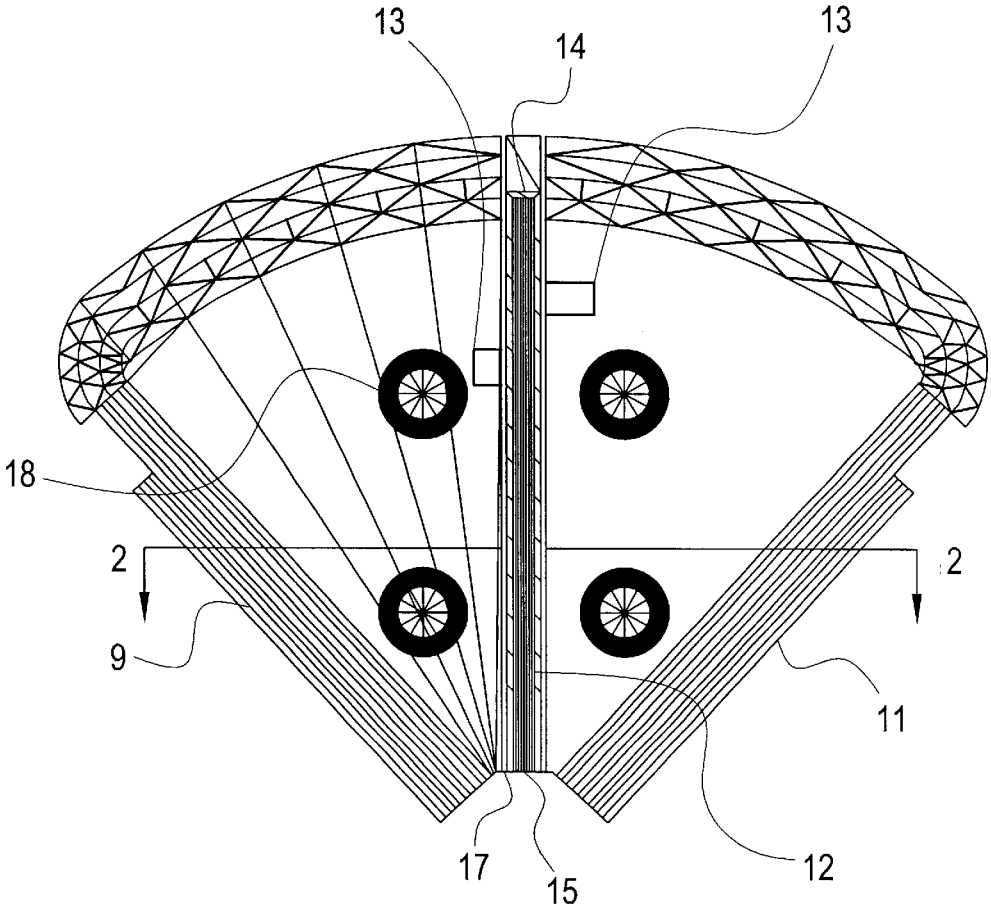
FIG. 1 is a top view of the fluid collection mat with fully exposed surface.

3. When the bell sounds the end of a ring event round, the mat 9, in it's folded state and connected to the engaged wet vacuum source 20, is placed in the corner of the ring under the bottom rope from either side. The mat 9 is unfolded to expose its maximum surface area, FIG. 1. The ring stool is placed on the gasket depressions 18 and the competitor can retire to rest upon the stool.

4. The mat 9, with it's sloped surface 10, through aid of gravity and wet vacuum source 20, extracts all fluids dispensed in the corners through the aperture openings 13, of the fluid extraction port 12, through the extraction port connector 16, through the flexible hose 19, to be collected by the wet vacuum source 20, thus eliminating hazardous wet corner conditions.

5. After the ring event break is completed the ring stool is removed, the mat 9 is folded and removed from the competitive surface under the bottom rope on either side. After removal from the ring, the wet vacuum source 20 is disengaged.

6. The procedures detailed in paragraphs 3—5, will be repeated during competition and as needed during training.

What I claim as my invention is:

1. A fluid collection system for collecting and removing fluids from the corners of ring events, comprising:

a mat, said mat having; a sloped surface from raised outer edges; a fluid extraction port with apertures for drainage; a fluid extraction port connector; and said sloped surface having raised gasket depressions adapted to support a ring stool;

a flexible hose having a first and second end, and;

a wet vacuum source;

wherein with the aide of gravity and said vacuum source, fluids are extracted from said mats sloped surface through said apertures in said fluid extraction port for collection in said wet vacuum source.

2. A fluid collection system as described in claim 1 wherein said fluid extraction port connector connects said flexible hose to said fluid extraction port at a first end and a second connection means is used to connect said second end of said flexible hose to said wet vacuum source.

3. A fluid collection system as described in claim 1 comprising hinge means for allowing said mat to fold for ease of deployment and removal.

* * * * *